US006305901B1

(12) United States Patent
Bell et al.

(10) Patent No.: US 6,305,901 B1
(45) Date of Patent: Oct. 23, 2001

(54) STEAM TURBINE

(75) Inventors: Ralf Bell, Kerken; Ulrich Capelle, Oberhausen; Armin Drosdziok, Essen; Jan-Erik Mühle; Mikhail Simkine, both of Mülheim an der Ruhr; Ingo Stephan, Görlitz; Volker Simon, Mülheim an der Ruhr, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/353,611

(22) Filed: Jul. 14, 1999

Related U.S. Application Data

(63) Continuation of application No. PCT/DE98/00062, filed on Jan. 9, 1998.

(30) Foreign Application Priority Data

Jan. 14, 1997 (DE) ..... 197 00 899

(51) Int. Cl.[7] ..... F01D 1/04; F01D 1/16; F01D 3/04

(52) U.S. Cl. ..... 415/100; 415/103; 415/107; 415/108; 60/653

(58) Field of Search ..... 415/99, 100, 101, 415/102, 103, 104, 107, 108, 93; 60/653

(56) References Cited

U.S. PATENT DOCUMENTS

| | | | | |
|---|---|---|---|---|
| 787,485 | * | 4/1905 | Westinghouse | 415/103 |
| 1,585,670 | * | 5/1926 | Hanzlik | 415/107 |
| 1,593,414 | * | 7/1926 | Kraft | 415/93 |
| 1,601,737 | * | 10/1926 | Johnson | 415/101 |
| 1,622,805 | * | 3/1927 | Pape | 415/101 |
| 2,174,806 | * | 10/1939 | Soderberg | 415/101 |
| 3,107,084 | * | 10/1963 | Conrad, Sr. et al. | 415/93 |
| 5,149,247 | * | 9/1992 | Gros et al. | 415/108 |
| 6,125,634 | * | 10/2000 | Wittchow | 60/678 |

FOREIGN PATENT DOCUMENTS

| | | | | |
|---|---|---|---|---|
| 236961 | * | 10/1925 | (GB) | 415/93 |

* cited by examiner

*Primary Examiner*—Christopher Verdier
(74) *Attorney, Agent, or Firm*—Herbert L. Lerner; Laurence A. Greenberg; Werner H. Stemer

(57) ABSTRACT

A steam turbine has a high-pressure turbine section and a medium-pressure turbine section fluidically connected to the high-pressure turbine section. The high-pressure turbine section is a chamber configuration and the medium-pressure turbine section is a drum configuration. Alternatively, the high-pressure turbine section is a drum configuration and the medium-pressure turbine section is a chamber configuration. Alternatively, or additionally, the high-pressure turbine section is a double-flow configuration and the medium-pressure turbine section is a double-flow configuration.

14 Claims, 5 Drawing Sheets

STEAM TURBINE

CROSS-REFERENCE TO RELATED APPLICATION

This application is a continuation of copending International Application No. PCT/DE98/00062, filed Jan. 9, 1998, which designated the United States.

BACKGROUND OF THE INVENTION

Field of the Invention

The invention relates to a steam turbine having a high-pressure turbine section and a medium-pressure turbine section fluidically connected to the high-pressure turbine section.

Known steam turbines are classified as action turbines (also called "constant-pressure" turbines) and reaction turbines (also called "excess-pressure" turbines). They have a turbine shaft with moving blades disposed on it and have an inner casing with guide blades disposed between axially spaced moving blades.

In the case of a constant-pressure turbine, the entire energy gradient is converted essentially into kinetic flow energy in he ducts that are narrowed by the guide blades. During the process, the velocity rises and the pressure falls. In the moving blades, the pressure and relative velocity remain essentially constant, being achieved through ducts having a uniform clear width. Because the direction of the relative velocity changes, action forces occur that drive the moving blades and, thus, cause rotation of the turbine shaft. The magnitude of the absolute velocity decreases considerably when the flow passes around the moving blades, resulting in a flow that transfers a large part of its kinetic energy to the moving blades and, therefore, to the turbine shaft.

In the case of an excess-pressure turbine, only part of the energy gradient is converted into kinetic energy when the flow passes through the guide blades. The rest of the energy gradient brings about an increase in the relative velocity within the moving-blade ducts formed between the moving blades. Where the blade forces are almost exclusively action forces in the constant-pressure turbine, in an excess-pressure turbine, a greater or lesser fraction resulting from the change in the velocity magnitude is added. The term "excess-pressure" turbine is derived from the pressure difference between the downstream and upstream side of the moving blade. In an excess-pressure turbine, therefore, a change in the velocity magnitude takes place when the pressure varies.

In a thermal turbo-machine, the percentage apportionment of the isentropic enthalpy gradient in the moving blades to the total isentropic enthalpy gradient by a stage having a guide-blade ring and moving-blade ring is designated as the isentropic reaction degree r. A stage in which the reaction degree r is equal to zero and the greatest enthalpy gradient occurs is designated as a pure constant-pressure stage. In the case of a classic excess-pressure stage, the reaction degree r is equal to 0.5, so that the enthalpy gradient in the guide blades is exactly the same as in the moving blades. For example, a reaction degree r equal to 0.75 is designated as a strong reaction. In steam-turbine construction practice, the classic excess-pressure stage and the constant-pressure stage are predominantly employed. However, as a rule, the latter has a reaction degree r that is somewhat different from zero.

Furthermore, the terms "chamber turbine" and "drum turbine" are used. Conventionally, a constant-pressure turbine employs a chamber configuration and an excess-pressure turbine employs a drum configuration. A chamber turbine has a casing that is divided into a plurality of chambers through intermediate floors disposed at an axial distance from one another. A disc-shaped rotor, on the outer periphery of which the moving blades are mounted, runs in each of these chambers, while the guide blades are inserted into the intermediate floors. One advantage of the chamber configuration is that the intermediate floors can be sealed off at their inner edge relative to the turbine shaft in a highly effectively manner through labyrinth gaskets. Because the gasket diameter is small, the gap cross-sections and, therefore, the gap leakage streams both become small. In known turbines, the configuration is used only in the case of low reaction degrees, that is to say a high stage gradient and, therefore, a small number of stages. The pressure difference on the two sides of a rotor disc is small in the case of a low reaction degree and, in the borderline case, is even zero. An axial thrust exerted on the rotor remains low and can be absorbed by an axial bearing.

In a drum turbine, the moving blades are disposed directly on the periphery of a drum-shaped turbine shaft. The guide blades are inserted either directly into the casing of the steam turbine or into a special guide-blade carrier. The moving blades and guide blades may also be provided with covering strips, to which labyrinth gaskets are attached, so that a sealing gap between the guide and moving blades and the turbine shaft and inner casing, respectively, is sealed off. Because these sealing gaps are located on large radii, at least in the case of the moving blades, the gap leakage streams are at all events considerably greater than in the case of chamber turbines. Due to the higher reaction degree, for example, r equal to 0.5, favorable flow paths in the blade ducts and, therefore, high efficiencies are achieved.

The axial overall length and the outlay for an individual stage are less than in a chamber turbine, but a larger number of stages is required because the reaction stages process a lower gradient. The axial thrust occurring in the blading is considerable. One possibility for counteracting the axial thrust is to provide a compensating piston, to the front side of which the pressure of the outlet port is applied through a connecting conduit.

A steam turbine of the drum configuration is described in German Published, Prosecuted Patent Application 20 54 465, corresponding to U.S. Pat. No. 3,754,833. A turbine shaft carrying the moving blades and an inner casing surrounding the turbine shaft are disposed in a pot-shaped outer casing. The inner casing carries the guide blades. The inner casing is connected to the outer casing through corresponding bearing and centering points for the absorption of an axial thrust.

A multi-stage steam turbine having high-pressure, medium-pressure and low-pressure turbine sections is described in U.S. Pat. No. 1,092,947 to Pape. The individual turbine sections are disposed in a single casing. The high-pressure section, which is a single stage, has a stationary guide blade that is disposed between two moving-blade rows disposed on a common wheel disc. The high-pressure section is, therefore, not a chamber configuration or a drum configuration. The medium-pressure section has a chamber configuration and the low-pressure section has a drum configuration. In a second embodiment, the low-pressure section is of the double-flow configuration.

A steam turbine having a high-pressure and a medium-pressure o turbine section is disclosed in U.S. Pat. No. 1,750,814 to Pape. The high-pressure turbine section has a drum configuration and the medium-pressure turbine section has a chamber configuration. The two turbine sections both may be disposed on a single shaft, or alternatively, on a separate shaft, and are each disposed in their own casing and are fluidically connected to one another. The high-pressure section has excess-pressure blading or constant-pressure blading.

A combined drum and disc-wheel turbine for steam, in which the last stage of the turbine is configured with disc wheels (chamber configuration), is specified in German Patent No. 448247. The entire steam turbine, including the section having a drum configuration and a section having a chamber configuration, is disposed in a single turbine casing.

SUMMARY OF THE INVENTION

It is accordingly an object of the invention to provide a steam turbine, which overcomes the hereinafore-mentioned disadvantages of the heretofore-known devices of this general type and which enables a higher efficiency.

With the foregoing and other objects in view, there is provided, in accordance with the invention, a steam turbine having a high-pressure chamber configuration turbine section, and a medium-pressure drum configuration turbine section fluidically connected to the high-pressure chamber configuration turbine section.

An additional degree of freedom in construction is obtained for increasing the overall efficiency through the use of the steam turbine, which can be considered a composite type. When the fresh steam supplied to the steam turbine is in an appropriate steam state, the benefits of the chamber configuration and of the drum configuration can be utilized in a deliberate way.

The high-pressure and the medium-pressure turbine sections may be both of single-flow and of double-flow configuration and may be disposed in separate outer casings, and even in a single, common outer casing also referred to as a "compact" turbine. When disposed separately, an outer casing of the high-pressure turbine section is preferably of pot-shaped configuration, such as is described, for example, in German Published, Prosecuted Patent Application 20 54 465, corresponding to U.S. Pat. No. 3,754,833. The outer casing may also have an axially divided configuration. The high-pressure turbine section can be located at an axial distance from the medium-pressure turbine section. In a version with separate casings, a low axial thrust occurs, inter alia, due to a low stage reaction (reaction degree) and to the chamber configuration of the high-pressure turbine section. A thrust-compensating piston may, therefore, be eliminated. Piston elimination has the effect of avoiding leakage losses caused by steam emerging from the thrust-compensating piston. Such avoidance of leakage losses leads to an increase in turbine efficiency.

Preferably, in an embodiment with separate outer casings, the medium-pressure turbine section is of double-flow configuration in order to eliminate a thrust-compensating piston. By a thrust-compensating piston, it is meant that, when acted upon by steam, a component by virtue of its geometrical shape, causes a resultant force directed counter to an axial thrust generated by the turbine blades in the event of a steam flow.

In a version of the steam turbine with an outer casing in which both the high-pressure turbine section and the medium-pressure turbine section are disposed (i.e., a "compact" turbine), at most, a low axial thrust occurs in the high-pressure turbine section, particularly due to the low stage reaction and the chamber configuration. As a result, the diameter of the turbine shaft region (intermediate floor), disposed between the high-pressure blading and the medium-pressure blading and configured as a thrust-compensating piston, can be made small. In particular, the diameter of the turbine shaft region (intermediate floor) can be smaller than the diameter of the turbine shaft in the region of the medium-pressure drum configuration turbine section. This makes it possible to reduce the leakage losses in the region of the seal between the medium-pressure turbine section and high-pressure turbine section (smaller annular area of the sealing gaps). Thus, leading to an increase in steam turbine efficiency.

An axial thrust generated by the medium-pressure turbine section can be compensated through a thrust-compensating piston. The piston is configured in such a way that the high-pressure blading is disposed between the thrust-compensating piston and the medium-pressure blading—as seen in the axial direction of the turbine shaft.

In an alternative embodiment of the invention, the high-pressure turbine section is of drum configuration and the medium-pressure turbine section is of chamber configuration, the high-pressure turbine section being of double-flow configuration. The two turbine sections may, in turn, be disposed in a common outer casing or, alternatively, in a separate outer casing. The medium-pressure turbine section, too, may have a double-flow configuration.

In an embodiment with a single outer casing (a "compact" turbine), at most, a low axial thrust emerges through the medium-pressure turbine section, in particular due to the low stage reaction (reaction degree) and the chamber configuration. Thus, eliminating a thrust-compensating piston for the medium-pressure turbine section. In order to absorb an axial thrust capable of being generated by the high-pressure turbine section, a turbine-shaft region (intermediate floor) disposed between the high-pressure blading and the medium-pressure blading is included, the turbine-shaft region having, both relative to the medium-pressure blading and relative to the high-pressure blading, an annular depression with corresponding radial end faces, because an intermediate floor is appropriate for a compact turbine for reasons of construction, the efficiency of the medium-pressure turbine section and, therefore, of the steam turbine as a whole, is increased by dispensing with an additional medium-pressure thrust-compensating piston. In an alternative version of the steam turbine, the medium-pressure turbine section is preferably of double-flow configuration, thereby avoiding an axial thrust of the medium-pressure turbine section. In order to absorb an axial thrust of the high-pressure turbine section, a thrust-compensating piston is preferably provided. Depending on the area of use, leakage losses, which may possibly occur, are compensated by high efficiency of the excess-pressure blading of the high-pressure drum configuration turbine section.

For both embodiments of the invention, the low-reaction stages (stages with a low reaction degree for the chamber configuration) lead to a rapid pressure reduction and to a corresponding rapid increase in the volume, and, consequently, in the flow cross-sections and blade heights. For the turbine stages located downstream in the direction of flow (each having a guide-blade structure and a moving-blade configuration located downstream in the direction of flow), there are, as compared with an excess-pressure stage, lower secondary losses and lower leakage losses through sealing gaps that are formed between the moving blades and the turbine wall and between the guide blades and the turbine shaft. Depending on the area of use of the steam turbine, in particular the fresh-steam state (temperature, pressure) of the steam supplied to the steam turbine and on the requirements with respect to the mass flow and a thermal and electric power to be achieved, low-reaction stages in the chamber configuration bring about a higher efficiency than excess-pressure stages in the drum configuration, or vice-versa. Depending on the intended area of use, therefore, one of the two alternatives of the invention, in each case with their fluidically adapted embodiments, is appropriate. Of course, a low-pressure turbine section may also be located downstream of the medium-pressure turbine section. A steam turbine according to the invention is particularly suitable for use in a coal-fired, steam power station. Electric power of approximately 50 MW up to more than 1500 MW can be achieved through the steam turbine. The fresh-steam state may amount to between 50 bar and 300 bar, with a temperature of up to 630° C. In the case of further developments in the sector of materials, in particular with regard to the turbine shaft and turbine casing, the temperature may be even higher.

Other features, which are considered as characteristic for the invention, are set forth in the appended claims.

Although the invention is illustrated and described herein as embodied in a steam turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
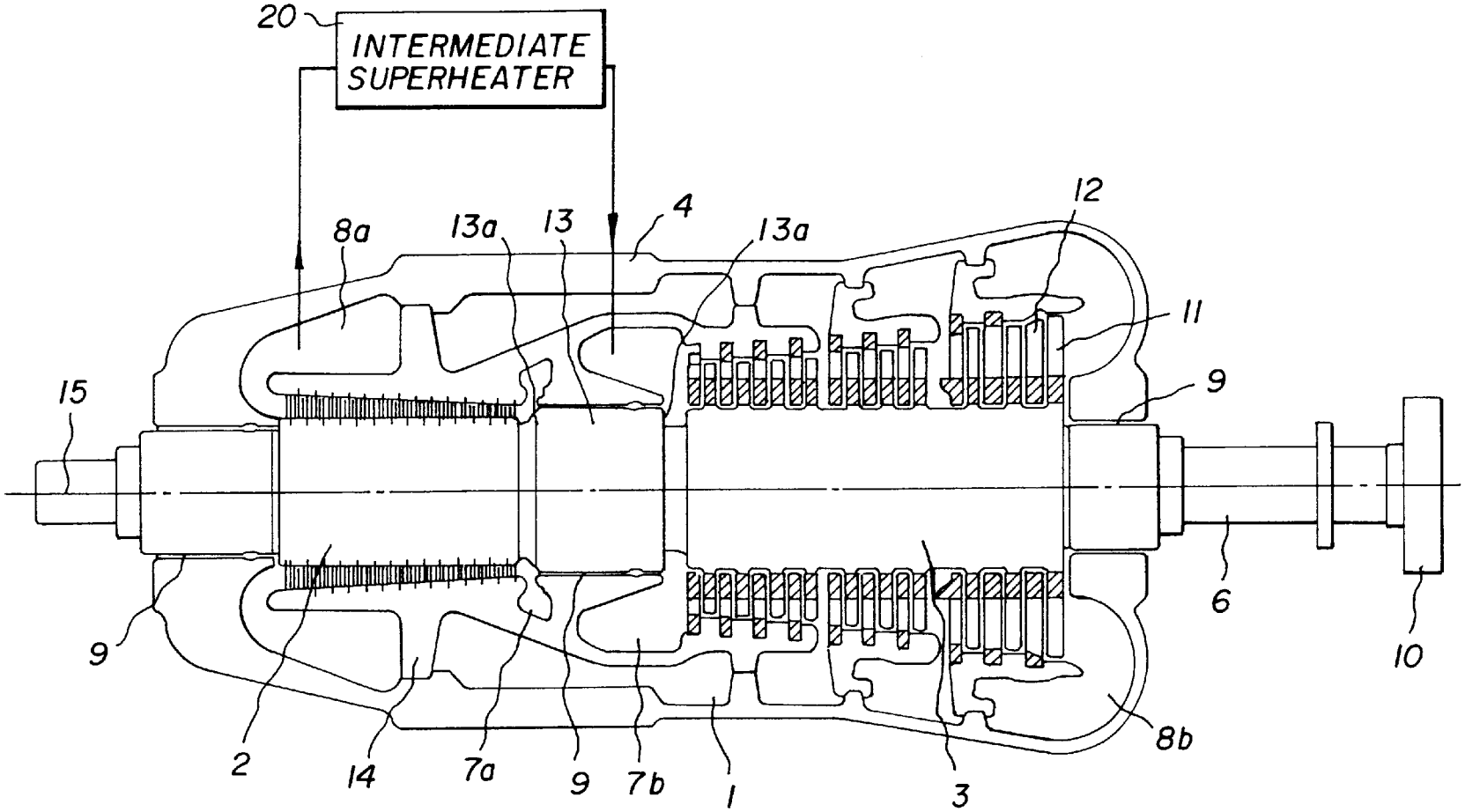
FIG. 1 is a diagrammatic, longitudinal-sectional view through a single-casing steam turbine with a high-pressure turbine section of the drum configuration and a medium-pressure turbine section of the chamber configuration according to the invention.

In all the figures of the drawing, sub-features and integral parts that correspond to one another bear the same reference symbol in each case.

Referring now to the figures of the drawings in detail and first, particularly, to FIG. 1 thereof, there is seen a steam turbine 1 having a single outer casing 4. A turbine shaft 6 directed along a turbine axis 15 is led through the outer casing 4. The turbine shaft 6 is sealed off relative to the outer casing 4 at the leadthroughs, not illustrated in any more detail, through respective shaft gaskets 9. A high-pressure turbine section 2 of a drum configuration is disposed within the casing 4. The high-pressure turbine section 2 includes high-pressure blading with moving blades 11 connected to the turbine shaft 6 and with guide blades 12, illustrated diagrammatically, connected to a high-pressure inner casing 14. Furthermore, a medium-pressure turbine section 3 of a chamber configuration, with moving blades 11 and guide blades 12 that are, once again, illustrated diagrammatically for the sake of clarity, is disposed within the inner casing 14. The turbine shaft 6 has, at one end, a shaft coupling 10 for coupling to a non-illustrated generator or to a non-illustrated low-pressure turbine section. A region or intermediate floor 13 of the turbine shaft 6 is configured axially between the high-pressure blading and the medium-pressure blading, the intermediate floor 13 serving for thrust compensation and being sealed off relative to the inner casing 14 through a corresponding shaft gasket 9. Between the intermediate floor 13 and the high-pressure turbine section 2 and medium-pressure turbine section 3, the turbine shaft 6 has a respective depression 13*a*, through which end faces are formed on the intermediate floor 13. One of these depressions 13*a* is connected to an inflow region 7*b* of the medium-pressure turbine section 3 and the other depression 13*a* is connected to a steam inlet 7*a* of the high-pressure turbine section 2. Fresh steam flowing into the steam inlet 7*a*, for example, at a pressure of approximately 170 bar and a temperature of 560° C., flows in the axial direction through the blading of the high-pressure turbine section 2 and, at a lower pressure, emerges from a steam outlet 8*a* of the high-pressure turbine section 2. The now partially expanded steam passes from the steam outlet 8*a* into an intermediate superheater 20 and is supplied to the steam turbine 1 again through the steam inlet 7*b* of the medium-pressure turbine section 3. The high-pressure turbine section 2 of the drum configuration, with excess-pressure blading, results in an axial thrust in the direction of the steam outlet 8*a*. This thrust is compensated through the intermediate floor 13 and the end faces formed by the depressions 13*a* because the pressure gradient across the high-pressure blading, that is to say from the steam inlet 7*a* to the steam outlet 8*a*, corresponds in an order of magnitude to the pressure difference across the intermediate floor 13 between the steam inlet 7*a* and steam inlet 7*b*. The medium-pressure turbine section 3 is of a chamber configuration with essentially constant-pressure blading. The intermediately superheated steam, flowing into the steam inlet 7*b* and flowing axially through the medium-pressure turbine section 3, leaves the steam turbine 1 through a steam outlet 8*b* of the medium-pressure turbine section 3. At most, a low axial thrust occurs in the medium-pressure turbine section 3.

A further thrust-compensating piston may, therefore, be dispensed with.

Figure 2:
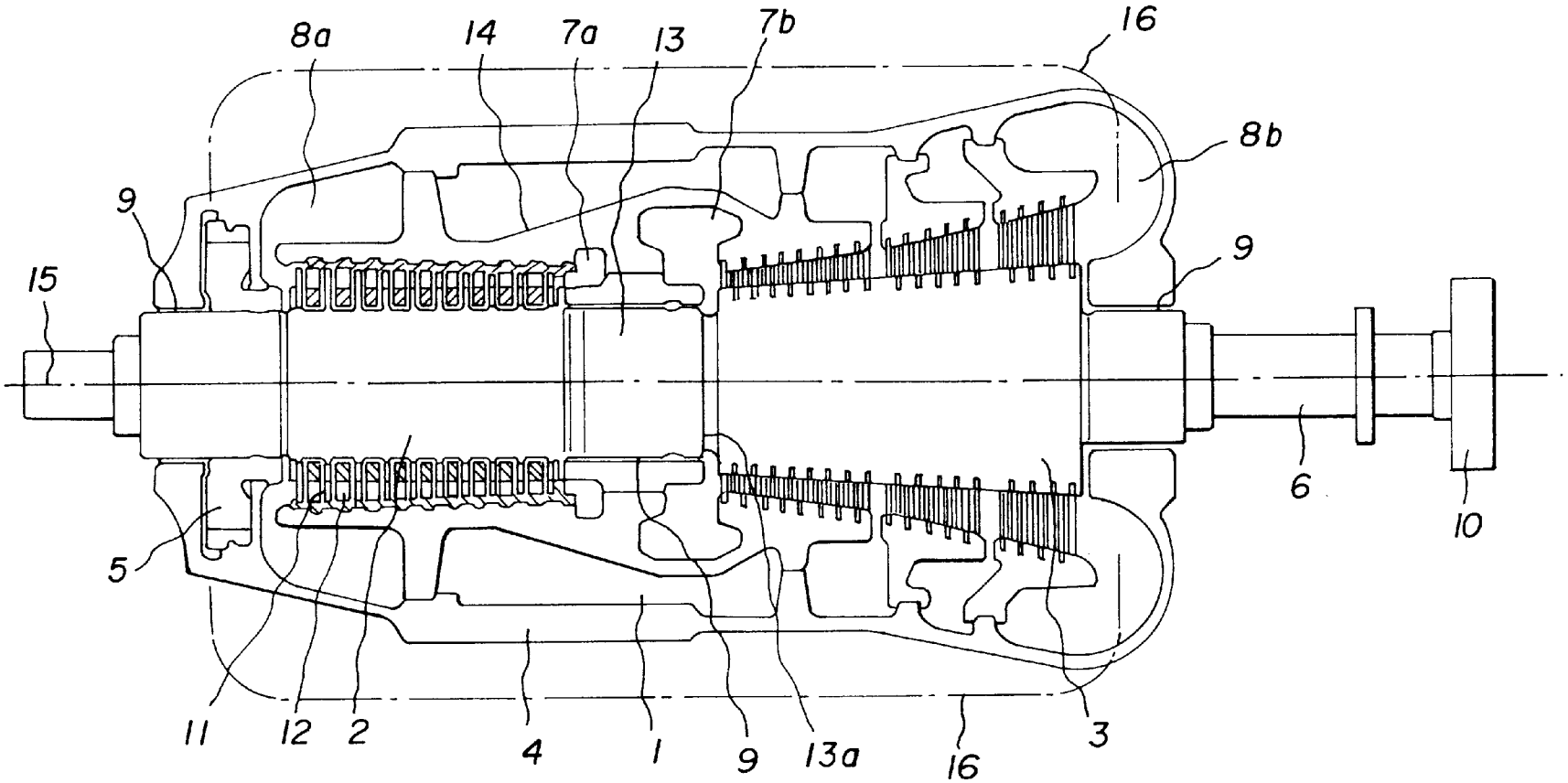
FIG. 2 is a diagrammatic, longitudinal-sectional view through a single-casing steam turbine with a high-pressure turbine section of the chamber configuration and a medium-pressure turbine section of the drum configuration according to the invention.

FIG. 2 shows a longitudinal section through a steam turbine 1 with a housing 4, in which a high-pressure turbine section 2 of chamber configuration and a medium-pressure turbine section 3 of drum configuration are disposed. An intermediate floor 13 is disposed between the high-pressure turbine section 2 and medium-pressure turbine section 3 in a similar way to FIG. 1. Because the high-pressure turbine section 2 generates a markedly lower axial thrust, as compared with the embodiment according to FIG. 1, the intermediate floor 13 has a smaller diameter and, on the medium-pressure side, a small depression 13*a*. In order to absorb an axial thrust of the medium-pressure turbine section 3 having a drum configuration, a thrust-compensating piston 5 that is connected to the steam outlet 8*b* of the medium-pressure turbine section 3 through a pressure conduit 16 is provided. This thrust-compensating piston 5 is disposed on the steam outlet side of the high-pressure turbine section 2, so that the high-pressure turbine section 2 is disposed axially between the thrust-compensating piston 5 and the intermediate floor 13, that is to say the medium-pressure turbine section 3. A low-pressure turbine section may be located downstream of the steam turbine 1 in a similar way to the embodiment according to FIG. 1.

Figure 3:
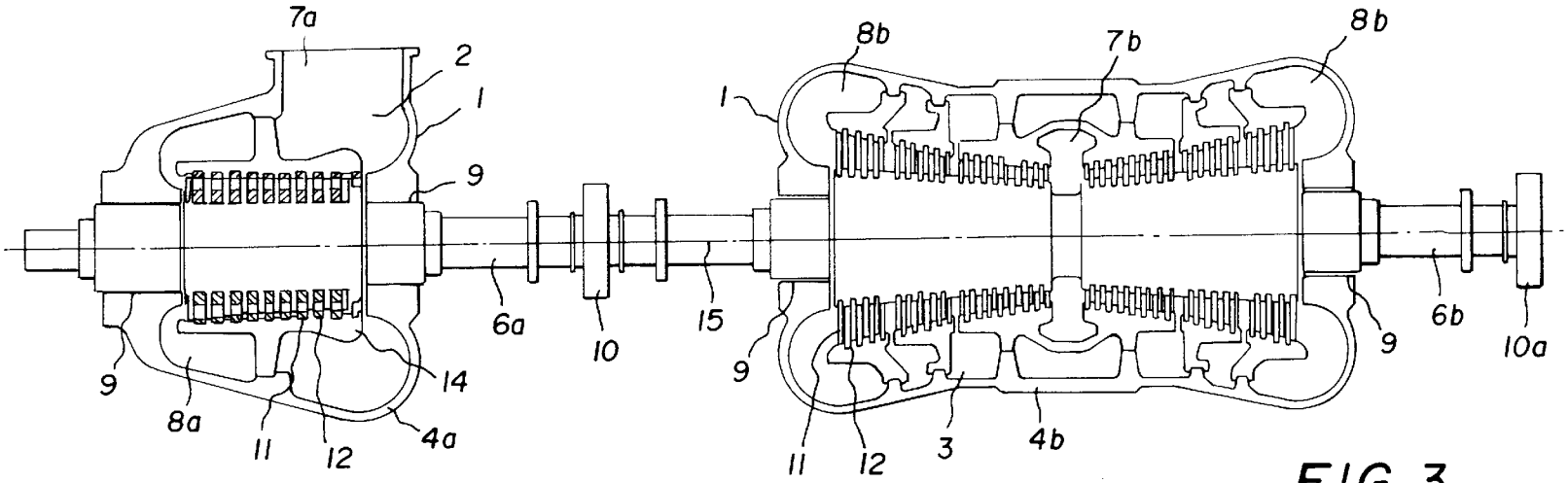
FIG. 3 is a diagrammatic, longitudinal-sectional view through a steam turbine with a high-pressure turbine section of the chamber configuration and a medium-pressure double-flow turbine section of the drum configuration disposed in outer casings separate from one another.
Figure 4:
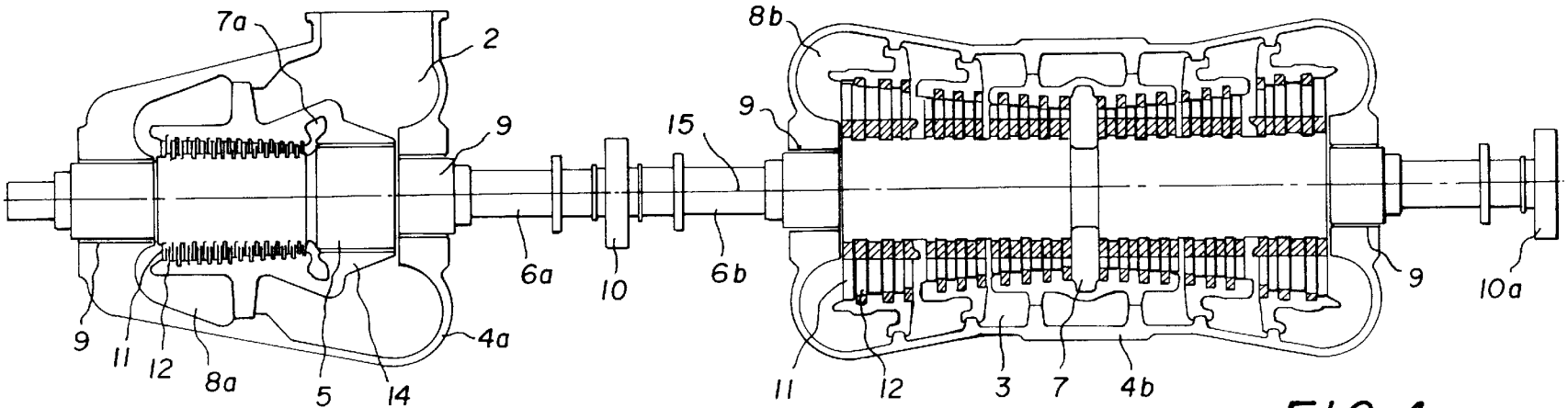
FIG. 4 is a diagrammatic, longitudinal-sectional view through a steam turbine with a high-pressure turbine section of the drum configuration and a medium-pressure double-flow turbine section of the chamber configuration disposed in outer casings separate from one another.

FIG. 3 and FIG. 4 each show a longitudinal section through a steam turbine 1 having a high-pressure turbine section 2 with an outer casing 4*a* and having a medium-pressure turbine section 3 with an outer casing 4*b* and located at an axial distance from the high-pressure turbine section 2. The medium-pressure turbine section 3 is of a double-flow configuration. A turbine shaft 6*a* of the high-pressure turbine section 2 is led through the outer casing 4*a* and is coupled by a shaft coupling 10 to a turbine shaft 6*b* led through the outer casing 4*b* of the medium-pressure turbine section 3. A further shaft coupling 10*a* for coupling to a non-illustrated generator or to a non-illustrated low-pressure turbine section is disposed on the turbine shaft 6*b*. In FIG. 3, the high-pressure turbine section 2 has a chamber configuration and the medium-pressure turbine section 3 has a drum configuration. Therefore, at most, a low axial thrust occurs in the high-pressure turbine section 2, so that there is no need for a thrust-compensating piston 5.

Figure 5:
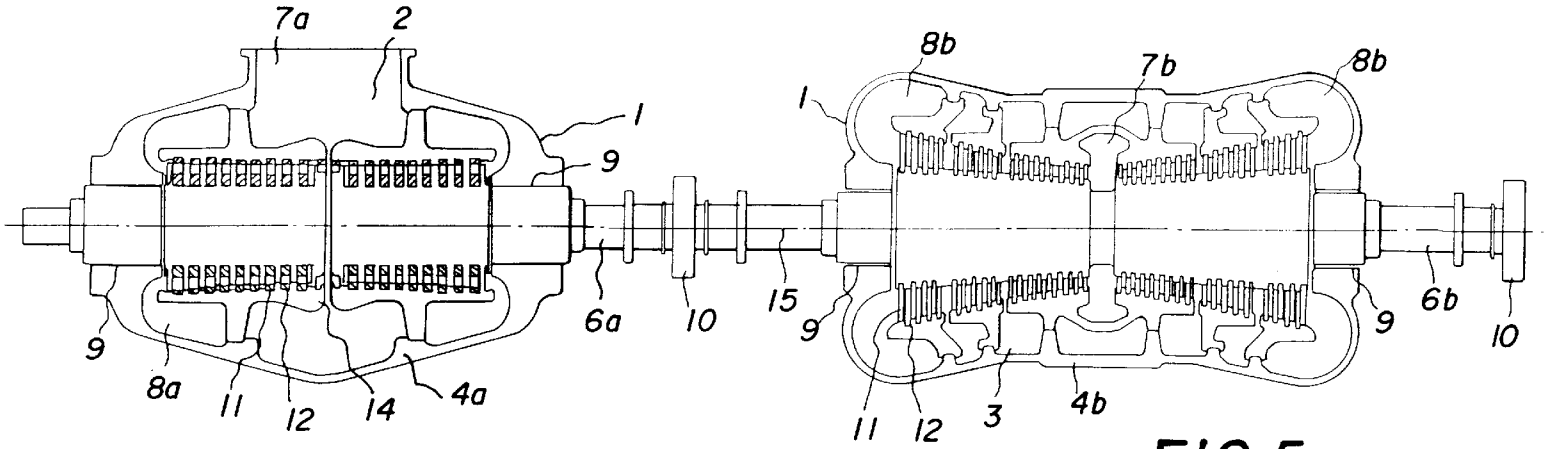
FIG. 5 is a diagrammatic, longitudinal-sectional view through a steam turbine with a high-pressure, double-flow turbine section of the chamber configuration and a medium-pressure double-flow, turbine section of the drum configuration disposed in outer casings separate from one another.

FIG. 5 illustrates a diagrammatic, longitudinal-sectional view through a steam turbine 1 having a high-pressure, double-flow turbine section 2 of the chamber configuration and a medium-pressure double-flow, turbine section 3 of the drum configuration. The two turbine sections 2, 3 are disposed in outer casings 4*a*, 4*b* separate from one another.

Figure 6:
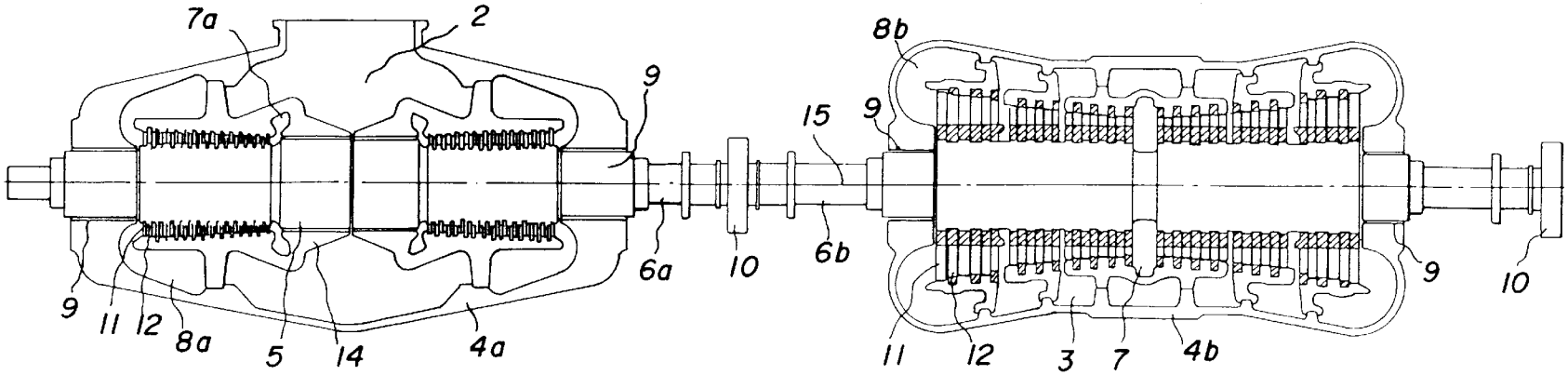
FIG. 6 is a diagrammatic, longitudinal-sectional view through a steam turbine with a high-pressure, double-flow turbine section of the drum configuration and a medium-pressure double-flow, turbine section of the chamber configuration disposed in outer casings separate from one another.

FIG. 6 illustrates a diagrammatic, longitudinal-sectional view through a steam turbine 1 with a high-pressure, double-flow turbine section 2 of the drum configuration and a medium-pressure double-flow, turbine section 3 of the chamber configuration. The two turbine sections 2, 3 are disposed in outer casings 4*a*, 4*b* separate from one another.

Figure 7:
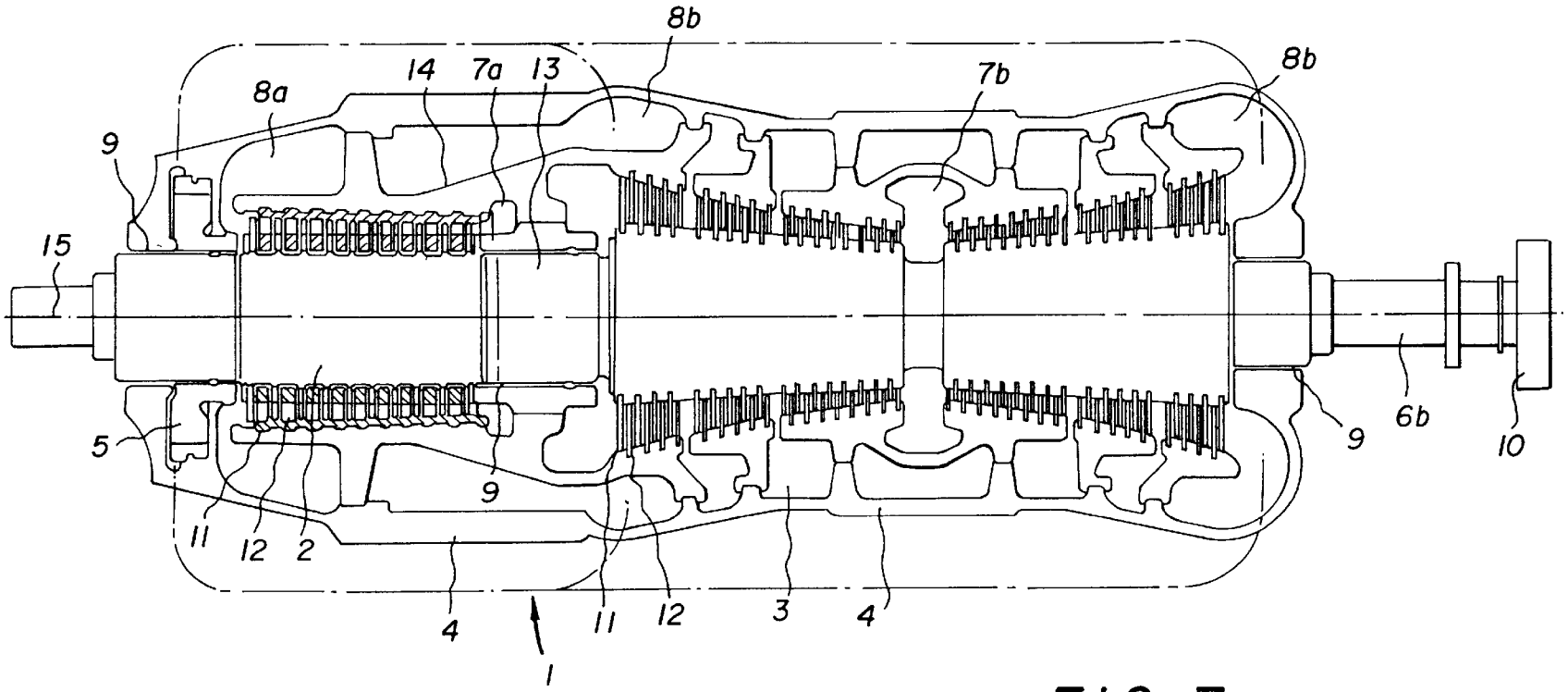
FIG. 7 is a diagrammatic, longitudinal-sectional view through a single-casing steam turbine with a high-pressure, double-flow turbine section of the drum configuration and a medium-pressure single-flow, turbine section of the chamber configuration.

FIG. 7 illustrates a diagrammatic, longitudinal-sectional view through a single-casing steam turbine 1 with a high-pressure, double-flow turbine section 3 of the drum configuration and a medium-pressure single-flow, turbine section 2 of the chamber configuration. The two turbine sections 2, 3 are in a single casing 4.

By contrast, in FIG. 4, the high-pressure turbine section 2 has a drum configuration and the medium-pressure turbine section 3 has a chamber configuration. An intermediate floor configured as a thrust-compensating piston 5 is disposed axially between the steam inlet 7*a* and casing 4*a*. The intermediate floor is fluidically connected on the casing side to the steam outlet 8*a*, so that the pressure difference between the steam inlet 7*a* and steam outlet 8*a* corresponds essentially to the pressure drop across the thrust-compensating piston 5 in the axial direction. Reference may be made to the description relating to FIG. 1 and FIG. 2 with regard to the configuration-related and functional features of the high-pressure turbine section 2 and of the medium-pressure turbine section 3. Identical reference signals have the same significance in FIG. 3 and FIG. 4 as in FIG. 1 and FIG. 2.

The invention is distinguished by a steam turbine 1 having a medium-pressure turbine section 3 and a high-pressure turbine section 2, the high-pressure turbine section 2 having a drum configuration and the medium-pressure turbine section 3 having a chamber configuration, or vice versa. The turbine sections may be disposed both in one casing (compact turbine) or in two separate casings. Depending on the area of use (steam pressure, steam temperature, steam mass flow and thermal or electric power of the steam turbine), a configuration having particularly high efficiency can be achieved by utilizing the advantages of both the chamber and drum configurations.

We claim:

1. A steam turbine comprising:

a high-pressure drum configuration turbine section having a high-pressure steam inlet and a high-pressure steam outlet;

a medium-pressure chamber configuration turbine section having a medium-pressure steam inlet and a medium-pressure steam outlet; and an intermediate superheater;

said medium-pressure chamber configuration turbine section fluidically connected to said high-pressure drum configuration turbine section from said high-pressure steam outlet to said medium-pressure steam inlet through said intermediate superheater.

2. The steam turbine according to claim 1, wherein said high-pressure chamber configuration turbine section is a double-flow configuration.

3. The steam turbine according to claim 1, including a single outer casing, said high-pressure chamber configuration turbine section and said medium-pressure drum configuration turbine section being disposed within said single outer casing.

4. The steam turbine according to claim 3, including a thrust-compensating piston for compensating an axial thrust of said medium-pressure drum configuration turbine section, said high-pressure chamber configuration turbine section being disposed axially between said medium-pressure drum configuration turbine section and said thrust-compensating piston.

5. The steam turbine according to claim 1, wherein said high-pressure chamber configuration turbine section has a high-pressure outer casing and said medium-pressure drum configuration turbine section has a medium-pressure outer casing located at an axial distance from said high-pressure outer casing.

6. The steam turbine according to claim 5, wherein said high-pressure outer casing is pot-shaped.

7. A steam turbine comprising:

a high-pressure drum double-flow configuration turbine section; and a medium-pressure chamber configuration turbine section fluidically connected to said high-pressure drum double-flow configuration turbine section.

8. The steam turbine according to claim 7, including a single outer casing, said high-pressure drum double-flow configuration turbine section and said medium-pressure chamber configuration turbine section being disposed within said single outer casing.

9. The steam turbine according to claim 8, wherein said medium-pressure chamber configuration turbine section is a double-flow configuration.

10. The steam turbine according to claim 8, including a thrust-compensating piston for compensating an axial thrust of said medium-pressure chamber configuration turbine section, said high-pressure drum double-flow configuration turbine section being disposed axially between said medium-pressure chamber configuration turbine section and said thrust-compensating piston.

11. The steam turbine according to claim 7, wherein said high-pressure drum double-flow configuration turbine section has a high-pressure outer casing and said medium-pressure chamber configuration turbine section has a medium-pressure outer casing located at an axial distance from said high-pressure outer casing.

12. The steam turbine according to claim 11, wherein said high-pressure outer casing is pot-shaped.

13. The steam turbine according to claim 11, wherein said medium-pressure chamber configuration turbine section is a double-flow configuration.

14. The steam turbine according to claim 7, wherein said medium-pressure chamber configuration turbine section is a double-flow configuration.

* * * * *